US005483917A

United States Patent [19]

Walker

[11] Patent Number: 5,483,917

[45] Date of Patent: Jan. 16, 1996

[54] LIGHT REFLECTING TRAFFIC DIRECTION WAND

[76] Inventor: Dale L. Walker, P.O. Box 445, McCamey, Tex. 79752

[21] Appl. No.: 315,227

[22] Filed: Sep. 29, 1994

[51] Int. Cl.[6] ..... E01F 9/00; G09F 15/00

[52] U.S. Cl. ..... 116/63 P; 116/63 R; 404/10; 40/608

[58] Field of Search ..... 116/63 P, 63 R, 116/28 R, 209, 173–175; 404/6, 9, 10; 40/606, 607, 608, 610, 612

[56] References Cited

U.S. PATENT DOCUMENTS

| | | | |
|---|---|---|---|
| D. 130,334 | 11/1941 | Bryant | D10/109 |
| D. 208,381 | 8/1967 | Miller | D10/109 |
| D. 260,742 | 9/1981 | Mihailoff | D10/109 |
| 3,237,330 | 3/1966 | Dinstbir | 116/28 R |
| 3,502,007 | 3/1970 | Andersson | 116/63 R |
| 4,645,168 | 2/1987 | Beard | 404/10 |
| 5,207,175 | 5/1993 | Andonian | 404/10 |
| 5,267,523 | 12/1993 | Hugron | 116/63 R |
| 5,363,792 | 11/1994 | Petechik | 116/28 R |

*Primary Examiner*—Thomas B. Will
*Assistant Examiner*—Andrew Hirshfeld

[57] ABSTRACT

A light reflecting traffic direction wand including a wand, the wand being positionable in a vertical orientation with an upper extent of an enlarged size and a lower extent of a reduced size, the upper extent and lower extent being formed in a curved configuration about a common vertical center of rotation, the upper extent being axially longer than the lower extent, the lateral extent of the upper extent being larger than the lateral extent of the lower extent; and a plurality of strips of reflective material secured to the interior surface of the upper and lower extent, such reflective material includes an upper strip located adjacent to the upper edge of the upper extent, an enlarged intermediate extent secured to the majority of the extent of the interior surface of the upper extent and a T-shaped member having its upper horizontal extent in the lower region of the upper extent and having its vertical component extent downwardly from the upper extent to the lower portion of the lower extent.

4 Claims, 4 Drawing Sheets

LIGHT REFLECTING TRAFFIC DIRECTION WAND

BACKGROUND OF THE INVENTION

1. Field of the Invention

The present invention relates to a light reflecting traffic direction wand and more particularly pertains to reflecting light from a wand for the purpose of directing traffic.

2. Description of the Prior Art

The use of light reflectors of various designs and configurations is known in the prior art. More specifically, light reflectors of various designs and configurations heretofore devised and utilized for the purpose of employing reflected light from an object through the use of a large number of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,580,659 a portable traffic sign.

U.S. Pat. No. 3,858,997 discloses a portable traffic sign and base therefor.

U.S. Pat. No. 5,165,818 discloses a traffic directing sign.

U.S. Pat. No. Des. 266,232 discloses the design of a traffic sign.

U.S. Pat. No. Des. 330,686 discloses the design of a traffic control stop sign.

In this respect, the light reflecting traffic direction wand according to the present invention substantially departs from the conventional concepts and designs of the prior art, and in doing so provides an apparatus primarily developed for the purpose of reflecting light from a wand for the purpose of directing traffic.

Therefore, it can be appreciated that there exists a continuing need for a new and improved light reflecting traffic direction wand which can be used for reflecting light from a wand for the purpose of directing traffic. In this regard, the present invention substantially fulfills this need.

SUMMARY OF THE INVENTION

In view of the disadvantages inherent in the known types of light reflectors of various designs and configurations now present in the prior art, the present invention provides an improved light reflecting traffic direction wand. As such, the general purpose of the present invention, which will be described subsequently in greater detail, is to provide a new and improved light reflecting traffic direction wand and method which has all the advantages of the prior art and none of the disadvantages.

To attain this, the present invention essentially comprises a new and improved light reflecting traffic direction wand comprising, in combination, a wand, the wand being positionable in a vertical orientation with an upper extent of an enlarged size and a lower extent of a reduced size, the upper extent and lower extent being formed in a curved configuration about a common vertical center of rotation, the upper extent being axially longer than the lower extent by between about 200 to 300 percent, the lateral extent of the upper extent being larger than the lateral extent of the lower extent by between about 40 and 60 percent, the juncture between the upper and lower extents including an S-shaped edge therebetween; a plurality of strips of reflective material secured to the interior surface of the upper and lower extents, such reflective material including an upper strip located adjacent to the upper edge of the upper extent, an enlarged intermediate extent secured to the majority of the interior surface of the upper extent and a T-shaped member having its upper horizontal extent in the lower region of the upper extent and having its vertical extent downwardly from the upper extent to the lower portion of the lower extent; a base having a lower horizontal surface, an upper horizontal surface and an arcuate slot formed downwardly from the upper surface, the slot being sized so as to receive the lower end of the lower extent; and a handle having an enlarged vertical extent and an oval cross-sectional configuration, the handle having a slot formed in the upper end thereof extending downwardly, the slot being of such size as to receive the lower end of the lower extent.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved light reflecting traffic direction wand which has all the advantages of the prior art light reflectors of various designs and configurations and none of the disadvantages.

It is another object of the present invention to provide a new and improved light reflecting traffic direction wand which may be easily and efficiently manufactured and marketed.

It is further object of the present invention to provide a new and improved light reflecting traffic direction wand which is of durable and reliable construction.

An even further object of the present invention is to provide a new and improved light reflecting traffic direction wand which is susceptible of a low cost of manufacture with regard to both materials and labor, and which accordingly is then susceptible of low prices of sale to the consuming public, thereby making such a light reflecting traffic direction wand economically available to the buying public.

Still another object of the present invention is to reflect light from a wand for the purpose of directing traffic.

Lastly, it is an object of the present invention to provide a new and improved light reflecting traffic direction wand comprising a wand, the wand being positionable in a vertical orientation with an upper extent of an enlarged size and a lower extent of a reduced size, the upper extent and lower extent being formed in a curved configuration about a common vertical center of rotation, the upper extent being axially longer than the lower extent, the lateral extent of the upper extent being larger than the lateral extent of the lower extent; and a plurality of strips of reflective material secured to the interior surface of the upper and lower extent, such reflective material including an upper strip located adjacent to the upper edge of the upper extent, an enlarged intermediate extent secured to the majority of the extent of the interior surface of the upper extent and a T-shaped member having its upper horizontal extent in the lower region of the upper extent and having its vertical component extent downwardly from the upper extent to the lower portion of the lower extent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
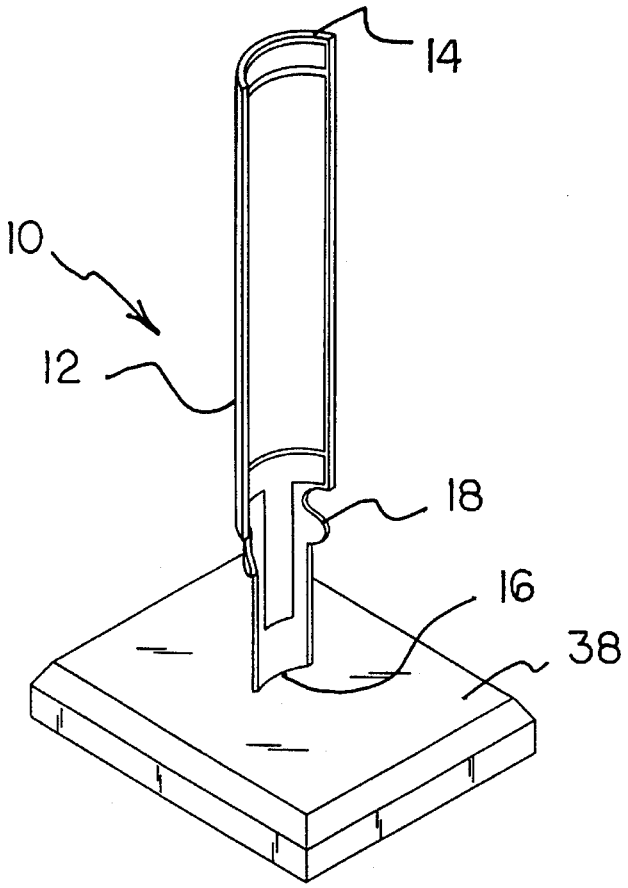
FIG. 1 is a perspective view of the preferred embodiment of the new and improved light reflecting traffic direction wand constructed in accordance with the principles of the present invention.
Figure 2:
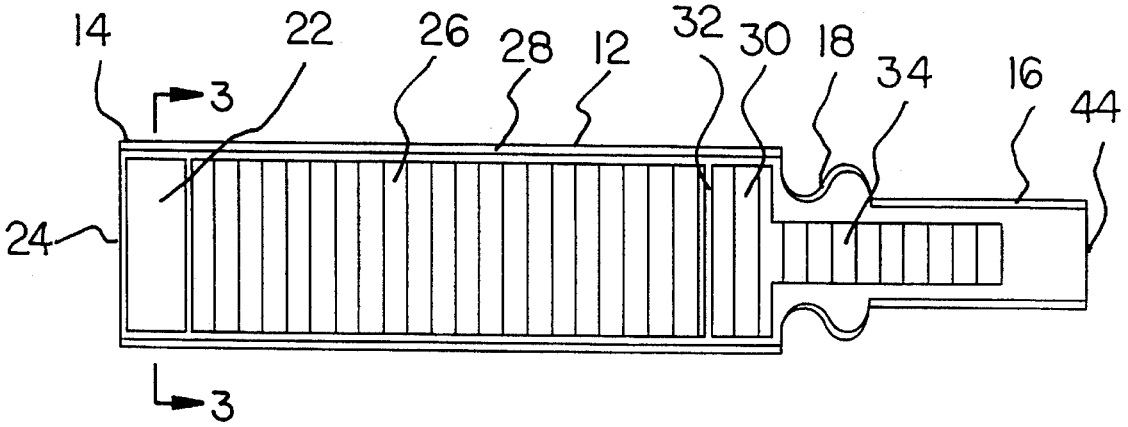
FIG. 2 is a partial front elevational view of the device shown in FIG. 1.
Figure 3:
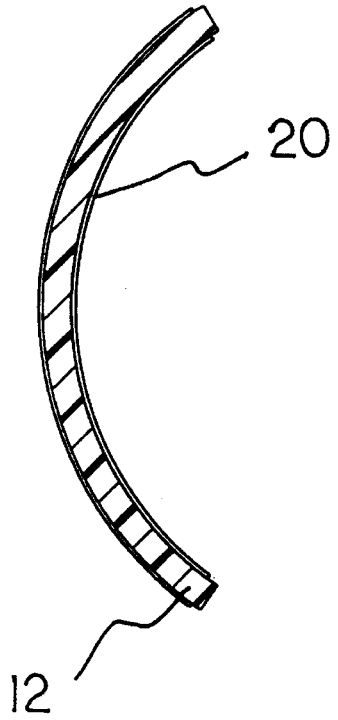
FIG. 3 is a cross-sectional view taken along line 3—3 of FIG. 2.
Figure 4:
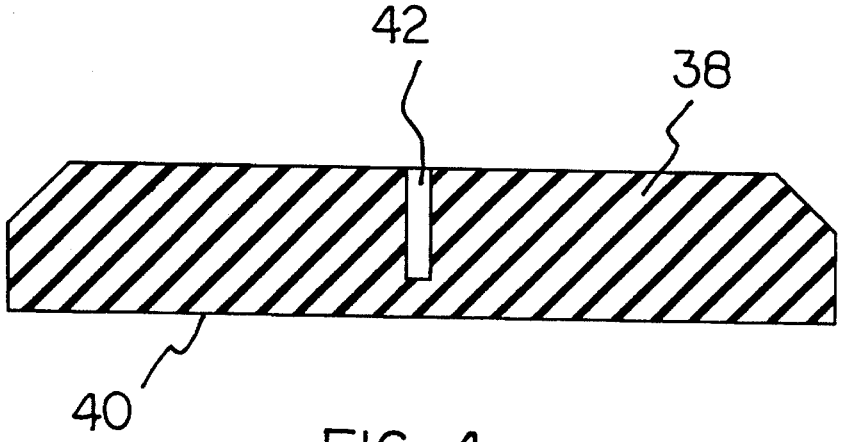
FIG. 4 is a cross-sectional view taken through the base shown in FIG. 1.
Figure 5:
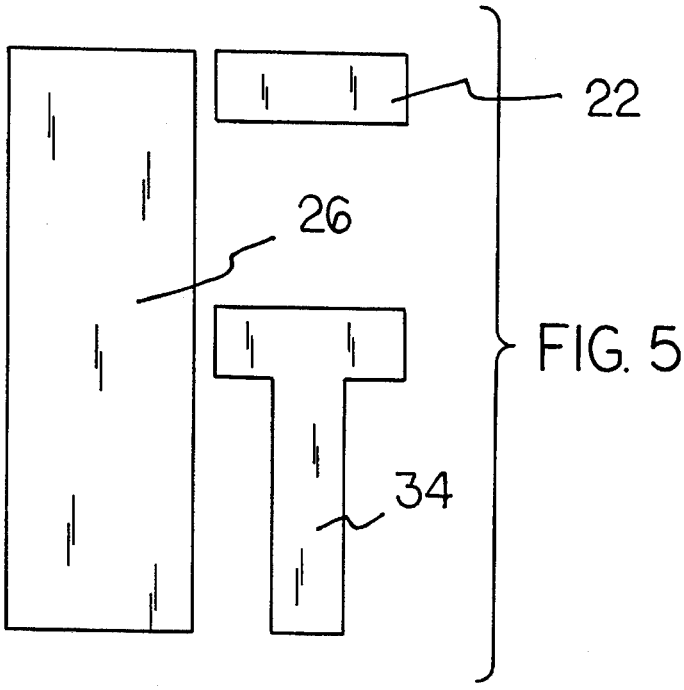
FIG. 5 is a plan view of the replaceable reflective material on the interior surface of the wand shown in FIGS. 1, 2 and 3.
Figure 6:
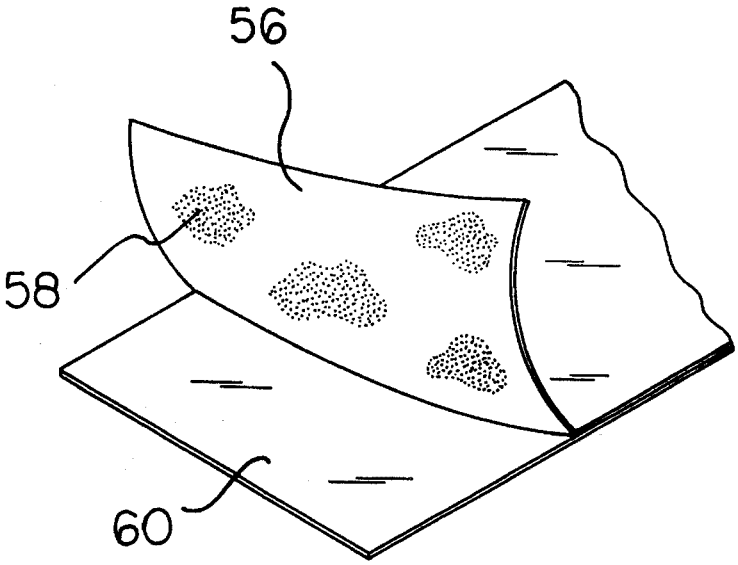
FIG. 6 is a perspective illustration of the reflective material with the vacuum sheet partially removed.
Figure 7:
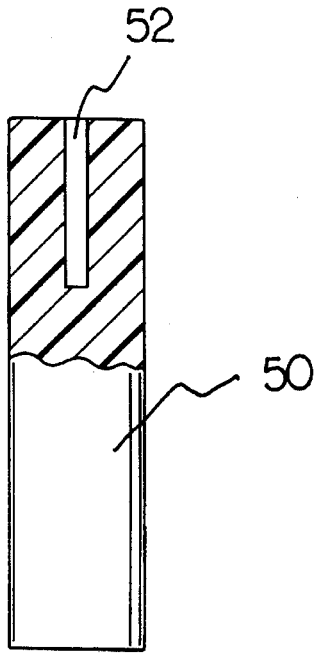
FIG. 7 illustrates a handle constructed in accordance with an alternate embodiment of the invention.
Figure 8:
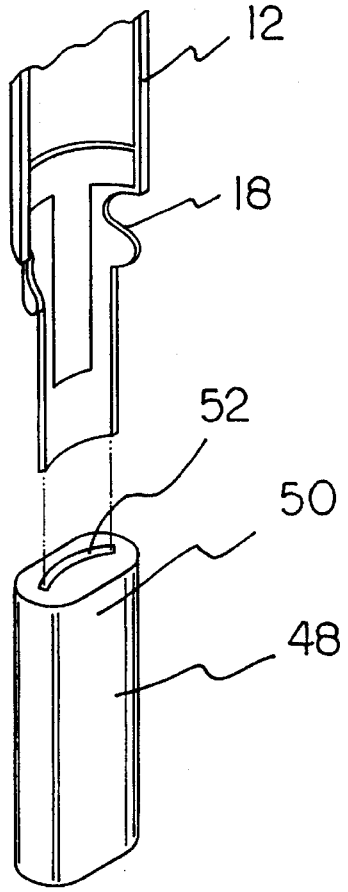
FIG. 8 is a perspective view of the handle shown in FIG. 7 with the lower extent of the wand in proximity thereto.

With reference now to the drawings, and in particular to FIG. 1 thereof, the preferred embodiment of the new and improved light reflecting traffic direction wand embodying the principles and concepts of the present invention and generally designated by the reference numeral 10 will be described.

The present invention, the new and improved light reflecting traffic direction wand is a system 10 comprised of a plurality of components. Such components, in their broadest context, include a wand, a plurality of strips of reflective materials, a base and a handle. Such components are individually configured and correlated with respect to each other so as to attain the desired objective.

The primary component of the system 10 is a wand 12. Such wand is adapted to be positioned in the vertical orientation. It has an upper extent 14 of an enlarged size and a lower extent 16 of a reduced size. Such enlarged and reduced sizes extend both longitudinally and horizontally. The upper extent and the lower extent are formed in a curved configuration about a common vertical center of rotation. The upper extent is axially longer than the lower extent by between about 200 and 300 percent, preferably 250 percent. The lateral extent of the upper extent is larger than the lateral extent of the lower extent by between about 40 and 60 percent, preferably 50 percent. The junction between the upper and lower extents includes an S-shaped edge 18 on each side of the wand.

The next component of the system 10 includes a plurality of strips of reflective material. They are secured at specific locations to the interior surface 20 of the upper and lower extents. Such reflective material includes an upper strip 22. The upper strip is located adjacent to the upper edge 24 of the upper extent. An enlarged intermediate extent or strip 26 is secured to the majority of the interior surface 28 of the upper extent. Lastly, provided is the T-shaped member or strip 30. The T-shaped strip has an upper horizontal extent 32 in the lower region of the upper extent and has its vertical component 34 extending downwardly from the upper extent to the lower portion of the lower extent.

The next component of the system 10 is the base 38. The base has a lower horizontal surface 40. It also has an upper horizontal surface parallel with the lower horizontal surface. It also has an arcuate slot 42 formed downwardly from the upper surface. Such slot is of a size so as to receive the lower end 44 of the lower extent of the wand.

The last component of the system 10 is a handle 48. Such handle has an vertical extent 50 and an oval crosssectional configuration. Such handle has a slot 52 formed in the upper end of the extent 50. It extends downwardly thereof from the upper end. The slot is of such size as to receive the lower end of the lower extent.

In operation and use, the wand 12 is adapted to be used by itself. It is preferred, however, to be inserted into either the base 38 as described above for a fixed location and use. In the alternative, it is adapted to be positioned into the handle 48 for being held by a person in directing traffic such as a police officer.

The present invention is a multi-purpose traffic direction device. It is designed by a police officer for use with any emergency vehicle. The present invention can be placed in its base and spaced out on the road around accident scenes, to block roads at fire scenes, or to warn of hazardous material spills, etc. Upon removal of the invention from its base, it instantly becomes a hand-held traffic wand. A benefit includes no more dead batteries in flashlights from lighted traffic wands. At night, the present invention can be seen up to one-half mile with headlights from any type vehicle. Its unique shape makes it easy to stack and store in a small duffle bag. It then saves on trunk space. By using the present invention at accident scenes, it will direct traffic itself, lighting a clear path for passersby to proceed, instead of having to strain their eyes looking for someone directing the traffic. This invention has already been used at accident scenes, and it saves time for accident personnel, freeing them to deal with the emergency at hand.

The present invention uses reflective materials made by 3M. The diamond grade of material already has approval by all state and federal requirements for its uses on all highways and roads. The reflective materials include, prior to placement in the wand, the reflective material 56, an adhesive 58 and a backing sheet 60 to be peeled off to expose the adhesive and then to be discarded. The stick of the invention itself can be made of a soft and flexible rubber or PVC material. The base needs to be of a heavy, flexible material such as solid rubber.

The present invention can also be specially designed for other uses than emergencies. It could be made without reflective material, but colored with fluorescent red orange and used as a hand wands, and parking lot marker.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A light reflecting traffic direction wand kit comprising, in combination:

a wand, the wand being positionable in a vertical orientation with an upper extent of an enlarged size and a lower extent of a reduced size, the upper extent and lower extent being formed in a curved configuration about a common vertical center of rotation, the upper extent being axially longer than the lower extent by between about 200 to 300 percent, the upper extent having a lateral extent and the lower extent having a lateral extent, wherein the lateral extent of the upper extent is larger than the lateral extent of the lower extent by between about 40 and 60 percent, a juncture between the upper and lower extents including an S-shaped edge therebetween;

a plurality of strips of reflective material secured to an interior surface of the upper and lower extents, such plurality of strips including an upper strip located adjacent to an upper edge of the upper extent, an enlarged intermediate strip secured to the majority of the interior surface of the upper extent and a T-shaped strip having an upper horizontal extent in a lower region of the upper extent and having a vertical extent downwardly from the upper extent to a lower portion of the lower extent;

a base having a lower horizontal surface, an upper horizontal surface and an arcuate slot formed downwardly from the upper horizontal surface, the slot being sized so as to be capable of receiving a lower end of the lower extent; and a handle having a vertical extent and an oval cross-sectional configuration, the handle having a slot formed in an upper end thereof extending downwardly, the slot of the handle being of such size as to be capable of receiving the lower end of the lower extent.

2. A light reflecting traffic direction wand comprising:

a wand, the wand being positionable in a vertical orientation with an upper extent of an enlarged size and a lower extent of a reduced size as compared to the upper extent, the upper extent and lower extent being formed in a curved configuration about a common vertical center of rotation, the upper extent being axially longer than the lower extent, the upper extent having a lateral extent and the lower extent having a lateral extent, wherein the lateral extent of the upper extent is larger than the lateral extent of the lower extent; and a plurality of strips of reflective material secured to an interior surface of the upper and lower extent, such plurality of strips including an upper strip located adjacent to an upper edge of the upper extent, an enlarged intermediate strip secured to the majority of the interior surface of the upper extent and a T-shaped strip having an upper horizontal extent in a lower region of the upper extent and having a vertical extent downwardly from the upper extent to a lower portion of the lower extent.

3. The device as set forth in claim 2 and further including:

a base having a lower horizontal surface, an upper horizontal surface and an arcuate slot formed downwardly from the upper horizontal surface, the slot being sized so as to receive a lower end of the lower extent.

4. The device as set forth in claim 2 and further including:

a handle having a vertical extent and an oval cross-sectional configuration, the handle having a slot formed in an upper end thereof extending downwardly, the slot of the handle being of such size as to receive a lower end of the lower extent.

* * * * *